United States Patent [19]

Muehl

[11] Patent Number: 4,784,386

[45] Date of Patent: Nov. 15, 1988

[54] SAFETY GRIPS FOR EXERCISE APPARATUS AND METHOD FOR ATTACHING

[75] Inventor: William H. Muehl, Madison, Wis.

[73] Assignee: National Institute of Biogerontology, Madison, Wis.

[21] Appl. No.: 19,745

[22] Filed: Feb. 27, 1987

[51] Int. Cl.[4] ..... A63B 21/02

[52] U.S. Cl. ..... 272/137; 272/142; 272/143

[58] Field of Search ..... 272/135, 136, 137, 142, 272/93, 143, 67, 68; 273/29 R, 26 E; 24/115 R, 115 H, 115 R, 129 R, 117

[56] References Cited

U.S. PATENT DOCUMENTS

| | | | |
|---|---|---|---|
| 1,638,003 | 8/1927 | Neumann | 272/137 |
| 2,929,632 | 3/1960 | Moffatt | 273/29 R |
| 2,932,072 | 4/1960 | Pruchnon | 24/129 R |
| 3,256,015 | 6/1966 | Parrin | 272/93 X |
| 3,652,085 | 3/1972 | Cole | 272/136 |
| 3,730,523 | 5/1973 | McRae | 272/67 |
| 3,807,730 | 4/1974 | Dalton et al. | 272/142 X |
| 4,079,934 | 3/1978 | Nixon | 273/26 E |
| 4,328,964 | 5/1982 | Walls | 272/136 |

*Primary Examiner*—Richard J. Apley
*Assistant Examiner*—J. Welsh
*Attorney, Agent, or Firm*—Keith Schoff

[57] ABSTRACT

Adjustable hand grips for an elastic exercise cable are provided by resilient hollow balls through which the cable is laced passing in holes which lie in at least two planes which intersect within each grip.

2 Claims, 1 Drawing Sheet

SAFETY GRIPS FOR EXERCISE APPARATUS AND METHOD FOR ATTACHING

FIELD OF ART

Elastic cord or tube is used in exercise apparatus for isometrically and isotonically conditioning muscles.

BACKGROUND OF INVENTION

Rubber cord or tube has been provided with grip members comprising rigid material by lacing, knotting, or expanding the end of the elastic member to retain a hand grip. In contrast to dead weight exercise equipment in which resistance to movement is gravitational with release of applied force resulting in weight dropping by gravity in intuitively understood manner, a resilient elastic member to which tensioning force is applied induces a reaction force acting in a direction opposite to that of applied force with the result that should a person fail to maintain proper control of the tension member either because it should slip from his grasp, or mechanically fail, or be improperly manipulated, rapid contraction of the stretched member will result with rebounding of the gri member which, if made from hard plastic or metal or other non-resilient material, can inflict serious injury if it should strike a person in the head, neck or other vital area of the body.

SUMMARY OF THE INVENTION

Hollow spherical elastomeric hand grips such as can be fashioned from tennis balls are connected to elastic tube or cord without use of fasteners or knots, by lacing the cord or tube through a series of holes provided in the walls of the ball grips in a manner which provides for an easily adjusted, non-slipping connection of light weight, resiliently deformable handles to the elastic member. Rebounding of the hand grips under sudden contraction of the elastic member will result in injury being inflicted which is no more serious than that suffered when hit by a hard driven tennis ball, and in addition nicking and marring of furniture and woodwork in the area where exercise equipment may be used is virtually eliminated by use of the invention. The provision of fiber nap coating as the facing for grips fashioned from tennis balls improves both tactile appeal of the apparatus and functional utility by absorbing perspiration from the hands of a user.

DESCRIPTION OF THE INVENTIVE EMBODIMENT

Figure 1:
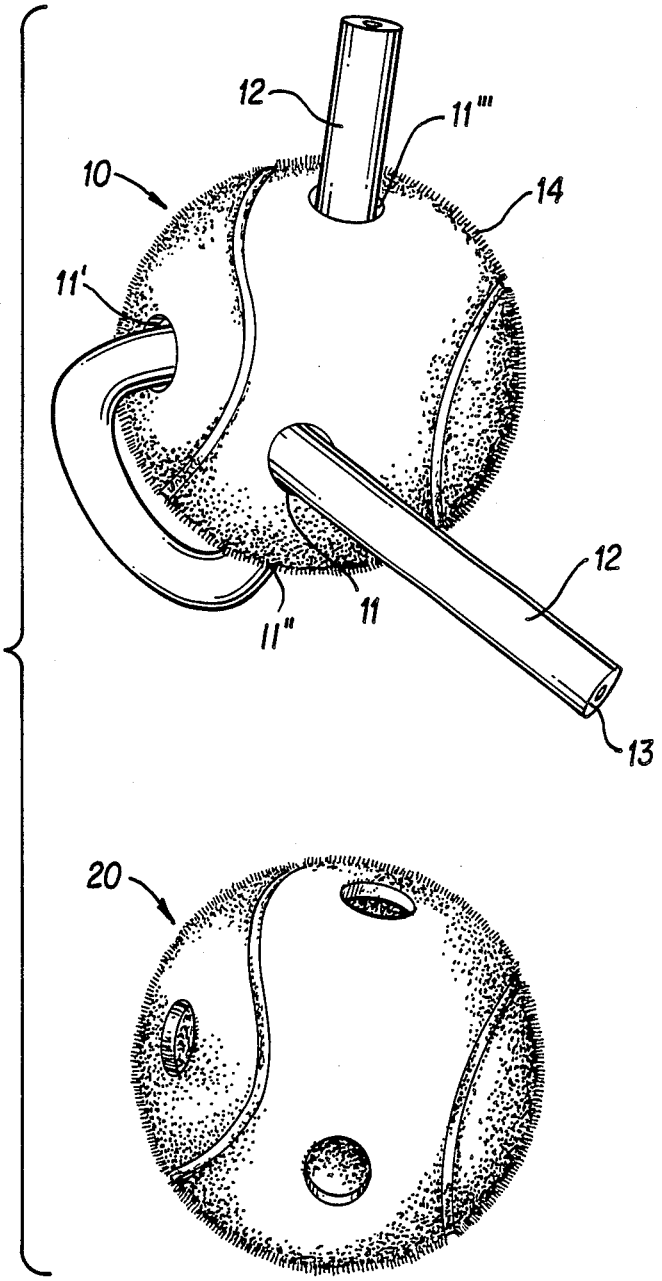
FIG. 1 is an elevation of an embodiment of this invention embodying rubber tubing shown abbreviated in length and connected to only one of the grip members for clarity in showing features of the other grip member.

In FIG. 1, two identically configured hollow spherical grips 10, 20 are shown each with four circular openings, 11, 11′, 11‴ disposed therein (shown only for grip 10) and 11″ which is concealed from view, the openings being disposed coincident with three mutually perpendicular axes which intersect at the center of the spherical grips. Rubber tubing 12 is laced through the openings in grip 10 with opening 11‴ being furthest from bitter end 13 of tubing 12 and with openings 11″, 11′, and 11 being progressively closer to end 13. As shown in FIG. 1, tubing 12 is truncated by being terminated beyond opening 11‴, however, this expedient is employed to more clearly show openings in grip 20 and in an actual embodiment tubing 12 would extend between grips 10 and 20 and be laced through both grips in identical manner. The resulting article would typically be used by a person standing on tubing 12 with one or both feet and stretching the tubing by grasping grips 10, 20, one in each hand, and extending his arms upward.

Both grips 10, 20 and tubing 12 comprise elastomeric material, preferaby natural latex with the grips being of higher durometer reading than the tubing. Natural latex tubing as marketed by Primeline Industries, Inc., Cayahoga Falls, Ohio, is suitable for tubing 12 and any tennis ball is suitable when provided with appropriate openings for use as grip 10 or 20. Suitable additives to provide color, abrasion resistance, and stability against deterioration as ordinarily provided in such products are desirable, with the essential requirement for use in this invention of tubing and grip components being that interfacial frictional resistance between components be sufficiently great to prevent slippage from occurring under tension loads applied to tubing 12. Grips 10, 20 as described will distort and virtually collapse as tension is increased to stretch tubing 12 to the maximum possible for a user to achieve, without the grips slipping on the tubing. When tension is released the grips and tubing will return to original configuration in relaxation enabling easy adjustment of the grips on the tubing to be made. In the event that a person fails to maintain his grasp on grip 10 or 20 while tubing 12 is stretched, any injury which might result will be no worse than that which might be sustained by a tennis player being hit by a hard driven ball, a condition for which there is substantial experience and one which rarely produces significant injury.

When grips 10, 20 are made from tennis balls, or simulations which include a fiber nap surface coating such as facing 14 as shown, the grips offer the advantage of being usable for manual squeezing exercised in addition to utility as grips for manual stretching of tubing 12, and provide the utilitarian and esthetically pleasing quality offered by a textured, perspiration absorbing nap surface. However, the principal attribute of grips 10, 20 is that they provide a margin of safety against injury in comparison to hard or heavy handles, particularly if the apparatus should be misused in a manner often engaged in by children or young adults who each grasp a handle and pull against the other in a tug of war until one or the other either loses his grip ro releases a handle intentionally, not perceiving that the result will be that the released handle will be propelled directly into the face of the other person with the possibility of fractures, loss of vision or other serious injury resulting. With rsilient, light weight hand grips 10, 20 provided by this invention, the likelihood of such injury resulting is virtually eliminated.

Openings 11, 11′, 11″, 11‴ as shown in FIG. 1 are disposed along three mutually perpendicular axes which intersect at the geometric center of grips 10. This is a preferred configuration, however, the point of intersection of the axes may be other than at the geometrical center of the spherically configured grip member, and the axes through the openings may deviate from mutual perpendicularity. If ready adjustability of a grip member is not sought, bitten end 13 of tubing 12 may be tucked within grip 10 and opening 11 be eliminated, although this is not preferred. Solid resilient elastic cord may be substituted for tubing 12 without significant loss of performance capability in the configuration shown for the apparatus of FIG. 1, however, because of decreased ability to distort the cross section of a solid core member as readily as that of an annular member such as tube 12, the frictional binding resistance of the member contacting grips 10, 20 will be less than for tube and the range of departure from the configuration shown in FIG. 1 which will provide suitable resistance to slippage between members will be less for solid cord than for tube.

I claim:

1. An elastic cable exercise device comprising (a) elastic cable, (b) elastomeric grip member for being manually grasped wherein each said grip member is configured as a resilient, hollow, closed surface, substantially spheroidal elastomeric body perforated with four perforations along three substantially mutually perpendicular axes through which said cable is laced to provide when said cable is stretched non-slip binding fastening said cable to said grip member.

2. The method of providing a connection between an elongated elastomeric member extending between handles disposed at each end portion thereof which is resistant to slippage when tension is operably applied to the device comprising the steps of providing handles of hollow elastomeric configuration having four openings in each disposed along three mutually substantially perpendicular axes which intersect within said configuration and of threading one end each of said elongated member through each said handle first through two said openings 11''' and 11'' in sequence which are situated on one said axis and then around the outside of said handle and into a third said opening 11' and lastly exiting said handle through a fourth said opening 11.

* * * * *